US011018423B2

(12) United States Patent
Lu et al.

(10) Patent No.: US 11,018,423 B2
(45) Date of Patent: May 25, 2021

(54) ANTENNA AND MANUFACTURING METHOD THEREOF

(71) Applicant: Alcatel Lucent, Nozay (FR)

(72) Inventors: Jinxing Lu, Shanghai (CN); Fei Gao, Shanghai (CN); Wei Wang, Shanghai (CN); Jiexing Gao, Shanghai (CN); Gang Shen, Shanghai (CN)

(73) Assignee: ALCATEL LUCENT, Nozay (FR)

( * ) Notice: Subject to any disclaimer, the term of this patent is extended or adjusted under 35 U.S.C. 154(b) by 0 days.

(21) Appl. No.: 16/327,455

(22) PCT Filed: Aug. 23, 2017

(86) PCT No.: PCT/IB2017/001106
§ 371 (c)(1),
(2) Date: Feb. 22, 2019

(87) PCT Pub. No.: WO2018/037278
PCT Pub. Date: Mar. 1, 2018

(65) Prior Publication Data

US 2019/0198992 A1 Jun. 27, 2019

(30) Foreign Application Priority Data

Aug. 23, 2016 (CN) ..... 201610711750.9

(51) Int. Cl.
*H01Q 3/24* (2006.01)
*H01Q 1/00* (2006.01)
(Continued)

(52) U.S. Cl.
CPC ..... *H01Q 3/24* (2013.01); *H01Q 1/007* (2013.01); *H01Q 9/285* (2013.01); *H01Q 19/106* (2013.01); *H01Q 21/20* (2013.01)

(58) Field of Classification Search
CPC ..... H01Q 1/00; H01Q 1/007; H01Q 3/24; H01Q 3/247; H01Q 9/28; H01Q 9/285; H01Q 19/10; H01Q 19/106; H01Q 21/20
See application file for complete search history.

(56) References Cited

U.S. PATENT DOCUMENTS

2008/0094299 A1* 4/2008 Williams ..... H01Q 3/242 343/836
2008/0252545 A1* 10/2008 Parsche ..... H01Q 19/106 343/836

(Continued)

FOREIGN PATENT DOCUMENTS

CN 105552575 A 5/2016
JP 2001-196847 A 7/2001

(Continued)

OTHER PUBLICATIONS

Alessandro Cidronali et al., "Analysis and Performance of a Smart Antenna for 2.4-GHz Single-Anchor Indoor Positioning," IEEE Transactions on Microwave Theory and Techniques, vol. 58, No. 1, pp. 21-31, Jan. 2010.

(Continued)

*Primary Examiner* — Thai Pham
(74) *Attorney, Agent, or Firm* — Fay Sharpe LLP

(57) ABSTRACT

The embodiments of the present disclosure provide an antenna and a method for manufacturing the same. The antenna includes a plurality of radiating plates oriented towards different directions for radiating electromagnetic waves; a plurality of reflecting plates for reflecting the electromagnetic waves, such that the electromagnetic waves radiated by the plurality of radiating plates each have a respective directional radiation pattern; and a switch for selecting a radiating plate from the plurality of radiating plates for performing radiation.

15 Claims, 6 Drawing Sheets

(51) Int. Cl.

| | |
|---|---|
| ***H01Q 9/28*** | (2006.01) |
| ***H01Q 19/10*** | (2006.01) |
| ***H01Q 21/20*** | (2006.01) |

(56) References Cited

U.S. PATENT DOCUMENTS

| | | | | |
|---|---|---|---|---|
| 2011/0080325 | A1* | 4/2011 | Livneh | H01Q 9/18 343/702 |
| 2013/0229262 | A1 | 9/2013 | Bellows | |
| 2014/0159958 | A1* | 6/2014 | Haziza | H01Q 3/24 342/374 |
| 2017/0222318 | A1* | 8/2017 | Li | H01Q 9/28 |

FOREIGN PATENT DOCUMENTS

| | | | |
|---|---|---|---|
| JP | 2002-124825 | A | 4/2002 |
| JP | 2003-152425 | A | 5/2003 |
| JP | 2006-050229 | A | 2/2006 |
| JP | 2016-506129 | A | 2/2016 |
| WO | WO 2008/003984 | A1 | 1/2008 |

OTHER PUBLICATIONS

International Search Report for PCT/IB2017/001106 dated Jan. 10, 2018.

* cited by examiner

ANTENNA AND MANUFACTURING METHOD THEREOF

FIELD

The present disclosure generally relates to wireless communications, and more specifically, to an antenna used in wireless communications and a method for manufacturing the same.

BACKGROUND

In recent years, rapid increasing demand has emerged for services and systems that depend upon accurate positioning of people and objects. In an indoor scenario, compared to methods of time of arrival (TOA), time difference of arrival (TDOA), and angle of arrival (AOA), using the received signal strength (RSS) may be a more appropriate approach to perform positioning since it can reuse the existing wireless infrastructure and thus tremendously save the hardware costs. Besides, almost all current standard commodity radio technologies, such as Wi-Fi, Zigbee, active radio frequency identification (RFID), and Bluetooth, provide RSS measurements, and the same algorithm can be applied across different platforms consequently.

However, there are complex multipath effects in an unpredictable indoor environment, including shadowing (i.e., blocking a signal), reflection (i.e., waves bouncing off an object), diffraction (i.e., waves spreading in response to obstacles), and refraction (i.e., waves bending as they pass through different mediums). Thus, the RSS measurements will be attenuated in unpredictable ways due to these effects.

One method of increasing the accuracy of an RSS positioning system is using the reconfigurable antenna. The reconfigurable antenna has various abilities, such as reconfiguring the radiation pattern, polarization, or even the operation frequency. Therefore, it can improve the link quality and enable spatial reusability, thereby having a positive impact in tackling the challenges of indoor positioning techniques employing RSS. Additionally, by switching between different antenna elements, a base station can establish a preferred communication with user equipment by each antenna, so as to increase the signal to noise ratio and reduce interferences in dense networks. It has been confirmed that specific reconfigurable antennas could be adopted to increase the channel capacity in Multiple Input Multiple Output MIMO systems, by using spatial and time diversity. However, existing reconfigurable antennas still have various defects and deficiencies and cannot satisfy the actual needs in communications.

SUMMARY

In one aspect of the present disclosure, there is provided an antenna. The antenna includes a plurality of radiating plates oriented towards different directions for radiating electromagnetic waves; a plurality of reflecting plates for reflecting the electromagnetic waves, such that the electromagnetic waves radiated by the plurality of radiating plates each have a respective directional radiation pattern; and a switch for selecting a radiating plate from the plurality of radiating plates for performing radiation.

In some embodiments, a planar dipole radiating element may be disposed on one side of the plurality of radiating plates. The planar dipole radiating element may include metal rings symmetrically disposed with respect to a symmetry axis. The metal rings may be rectangular metal rings.

A width of a metal patch of the metal rings may be set to broaden an operation bandwidth of the antenna to a predetermined bandwidth. In some embodiments, an L-shaped feeding stub may be disposed on the other side of the plurality of radiating plates. An end of the feeding stub may be connected to one of the metal rings through a via. In some embodiments, the planar dipole radiating element may be fed through a coaxial cable.

In some embodiments, the plurality of radiating plates may form sides of a regular prism. In some embodiments, the regular prism may be a regular triangular prism, and the plurality of radiating plates may be three radiating plates, and wherein the plurality of reflecting plates may be three reflecting plates, and the three reflecting plates may respectively be positioned in three planes defined by lateral edges and a center axis of the regular triangular prism. In other embodiments, the regular prism may be a regular quadrangular prism, and the plurality of radiating plates may be four radiating plates and wherein the plurality of reflecting plates may be eight reflecting plates and four reflecting plates of the eight reflecting plates may respectively be in parallel with four sides of the regular quadrangular prism and form an internal regular quadrangular prism within the regular quadrangular prism, and the other four reflecting plates of the eight reflecting plates may respectively be positioned in four planes defined by lateral edges of the internal regular quadrangular prism and corresponding lateral edges of the regular quadrangular prism.

In some embodiments, the antenna may further include a bottom plate for fixing the plurality of radiating plates and the plurality of reflecting plates. The bottom plate also provides an electrical connection for the plurality of radiating plates. The switch may be disposed on the bottom plate. In some embodiments, the antenna may further include a top plate for fixing the plurality of radiating plates and the plurality of reflecting plates.

In another aspect of the present disclosure, there is provided a method for manufacturing the above antenna.

BRIEF DESCRIPTION OF THE DRAWINGS

Through the following detailed description with reference to the accompanying drawings, the above and other objectives, features, and advantages of embodiments of the present disclosure will be easier to understand. Several example embodiments of the present disclosure will be illustrated by way of example but not limitation in the drawings in which.

Throughout the drawings, same or similar reference numbers are used to indicate the same or similar elements.

DETAILED DESCRIPTION OF EMBODIMENTS

Figure 1:
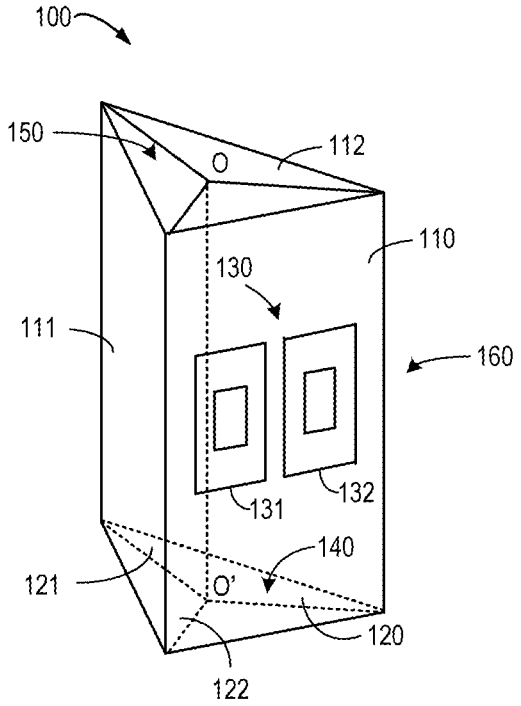
FIG. 1 schematically illustrates an antenna according to an embodiment of the present disclosure.

Principles and spirits of the present disclosure will now be described with reference to various example embodiments illustrated in the drawings. It should be appreciated that description of those embodiments is merely to enable those skilled in the art to better understand and further implement the present disclosure and is not intended for limiting the scope disclosed herein in any manner.

As mentioned above, existing reconfigurable antennas still have various defects and deficiencies. In some existing solutions, a single-anchor indoor positioning system uses a switched-beam antenna, wherein the reconfigurable antenna is a combination of six adjacent radiating elements, which are assembled to form a semi dodecahedron. Each radiating element is implemented in the microstrip antenna technology and is fed by a coaxial probe, with a circular polarization design. A single-pole six-throw radio frequency switch is used to multiplex each radiating element. Under control of a base station, the radio frequency switch connects one of the six radiating elements to the transceiver.

In some other existing solutions, there is provided another reconfigurable antenna. Similarly, this reconfigurable antenna includes a radio frequency feed port (at the center of the antenna) and six antenna branches. Each antenna branch includes one V-shaped planar dipole driven element, one V-shaped director and two straight reflectors. The resultant bent dipole can provide a directional radiation pattern with a horizontal polarization. The hexagonal-shaped ground section also plays a role of a main reflector. Besides, the director and the reflectors concentrate the directional radiation pattern and give an additional radiation gain.

However, the design of these reconfiguration antennas still has some problems. First of all, the existing reconfigurable antennas are a not wideband antennas, which would limit some algorithms and their deployment in multi-scenarios. Secondly, the number of switchable radiating elements is unsuitable. In most cases, the method of RSS positioning only uses two or three beams. More beam selectivity fails to improve the accuracy of the RSS much, but increases the complexity of control circuits. This view point is confirmed in some tests. Thirdly, the front-back ratio of the gain pattern is low. In order to reduce the interference from the back direction, the front-back ratio should be more than 20 dB and as great as possible. The front-back ratio of the existing antennas is just about 10 dB. Fourthly, it should be determined which one of the circular polarization and the linear polarization is better for the RSS depending on the specific indoor environments.

In view of the above analysis and discussion, to solve the various defects and deficiencies of the existing reconfigurable antennas, the embodiments of the present disclosure present a compact wideband pattern reconfigurable antenna. The structure of the antenna according to an embodiment of the present disclosure is first described with reference to FIGS. 1 to 4.

FIG. 1 schematically illustrates an antenna 100 according to an embodiment of the present disclosure. As shown in FIG. 1, the antenna 100 includes three radiating plates 110, 111 and 112 for radiating electromagnetic waves, such as electromagnetic wave signals transmitted for indoor positioning. It should be understood that the antenna 100 in FIG. 1 including three radiating plates 110, 111 and 112 is only an example. Other embodiments of the present disclosure may include other number of radiating plates, such as two, four, five or more. The scope of the present disclosure is not restricted in this regard.

To radiate electromagnetic waves, a planar dipole radiating element 130 may be disposed on one side of the radiating plate 110. Although FIG. 1 does not depict the details of the radiating plates 111 and 112 for the sake of simplicity, the radiating plates 111 and 112 may also be provided with respective planar dipole radiating elements. In some embodiments, the dipole radiating element 130 may include two metal rings 131 and 132 disposed in symmetry. It should be appreciated that it is only an example implementation to form the dipole radiating element 130 using the metal rings 131 and 132. The embodiments of the present disclosure may also utilize any other suitable types of dipole radiating elements. As further shown in FIG. 1, the radiating plates 110, 111 and 112 are disposed to face different directions, such that the electromagnetic waves transmitted by the antenna 110 can cover a spatial angle of 360 degrees.

The antenna 100 also includes three reflecting plates 120, 121 and 122 for reflecting the electromagnetic waves, such that the electromagnetic waves radiated by the radiating plates 110, 111 and 112 each have a respective directional radiation pattern. For example, in the embodiment of FIG. 1, the radiating plates 110, 111 and 112 form the three sides of a regular triangular prism 160 and the reflecting plates 120, 121 and 122 are respectively positioned in three planes defined by lateral edges and a center axis O-O' of the regular triangular prism 160. Under such an arrangement, the reflecting plates 120 and 122 jointly reflect the electromagnetic waves radiated by the radiating plate 110, such that the electromagnetic waves of the radiating plate 110 have a substantially forward radiation pattern.

Similarly, the reflecting plates 120 and 121 jointly reflect the electromagnetic waves radiated by the radiating plate 112, such that the electromagnetic waves of the radiating plate 112 have a substantially forward radiation pattern. The reflecting plates 121 and 122 jointly reflect the electromagnetic waves radiated by the radiating plate 111, such that the electromagnetic waves of the radiating plate 111 have a substantially forward radiation pattern.

It should be understood that the antenna 100 in FIG. 1 including three reflecting plates 120, 121 and 122 is only an example. Other embodiments of the present disclosure may include other number of reflecting plates, such as two, four, five or more. The scope of the present disclosure is not restricted in this regard. Furthermore, it should be appreciated that the directions and positions of the reflecting plates 120, 121 and 122 depicted in FIG. 1 is only an example. In other embodiments of the present disclosure, the reflecting plates 120, 121 and 122 can have different positions and orientations. The embodiments of the present disclosure are not limited in this regard.

Additionally, the antenna 100 also includes a switch and the switch of the antenna 100 is not illustrated in FIG. 1 for the sake of simplicity. The switch of the antenna 100 is used for selecting a radiating plate from the radiating plates 110, 111 and 112 for performing radiation. For instance, the radiating plate 110 may be selected via the switch of the antenna 100 for performing radiation to cover a spatial range of about 120 degrees, and more than one radiating plate can also be selected via the switch of the antenna 100 to cover a spatial range of a greater angle. In some embodiment, the switch of the antenna 100 may be a single-pole multi-throw (SPNT) switch or other switching components. Besides, the antenna 100 may employ a non-reflective type of switches to minimize the interaction among the radiating plates 110, 111 and 112.

Moreover, the antenna 100 may further include a bottom plate 140 for fixing the radiating plates 110, 111 and 112 and the reflecting plates 120, 121 and 122. In some embodiments, the bottom plate 140 can also provide an electrical connection for the radiating plates 110, 111 and 112, such as a radio frequency electrical connection, a direct current electrical connection, etc. In these embodiments, the switch of the antenna 100 can also be disposed on the bottom plate 140. Besides, the antenna 100 may include a top plate 150 for further fixing the radiating plates 110, 111 and 112 and the reflecting plates 120, 121 and 122. In some embodiments, the electrical connection can also be provided for the radiating plates 110, 111 and 112 through the top plate 150.

Figure 2:
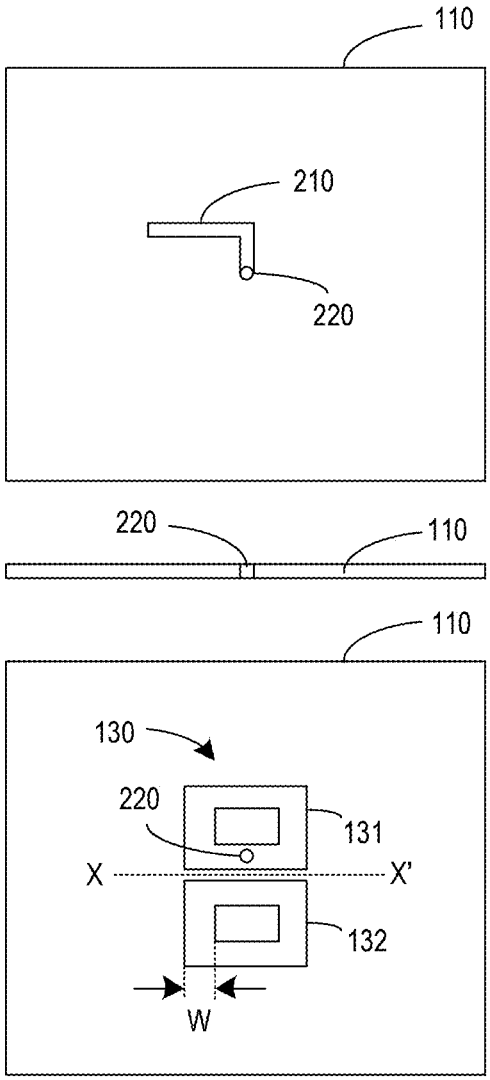
FIG. 2 schematically illustrates multiple views of a radiating plate of the antenna according to an embodiment of the present disclosure.

In the following, the radiating plate 110 is taken as an example to describe the structure of the radiating plate of the antenna 100 with reference to FIG. 2. FIG. 2 schematically illustrates multiple views of the radiating plate 110 of the antenna 100 according to an embodiment of the present disclosure, wherein the upper view is a top view of the radiating plate 110, the middle view is a side view of the radiating plate 110 and the lower view is a bottom view of the radiating plate 110.

As shown in FIG. 2, the planar dipole radiating element 130 may be disposed on one side (e.g., the bottom side) of the radiating plate 110. The planar dipole radiating element 130 may include metal rings 131 and 132 disposed symmetrically with respect to a symmetry axis X-X'. In the embodiment of FIG. 2, the metal rings 131 and 132 may be rectangular metal rings. It should be understood that showing the metal rings 131 and 132 in a rectangular shape in FIG. 2 is only an example. Other embodiments of the present disclosure may employ metal rings of other shapes, such as circular metal rings, square metal rings and the like.

The width W of the metal patch of the metal rings 131 and 132 can be arranged to broaden the operation bandwidth of the antenna 100 to a predetermined bandwidth. That is, the width of the metal rings 131 and 132 may be broadened relative to the width of microstrip lines of conventional microstrip dipoles, such that the antenna 100 may have a broader bandwidth, such as a −20 dB bandwidth greater than 200 MHz.

As further shown in FIG. 2, on the other side (e.g., the top side) of the radiating plate 110, there may be disposed with a L-shaped feeding stub 210. One end of the feeding stub 210 may be connected to one of the metal rings 131 and 132 (metal ring 131 in the illustrated embodiment) through a via 220 to feed the planar dipole radiating element 130. It should be understood that the feeding stub 210 is only an example feeding line structure and other embodiments of the present disclosure can also employ other feeding line structures to feed the planar dipole radiating element 130. Moreover, the planar dipole radiating element 130 may be fed via a coaxial cable.

Figure 3:
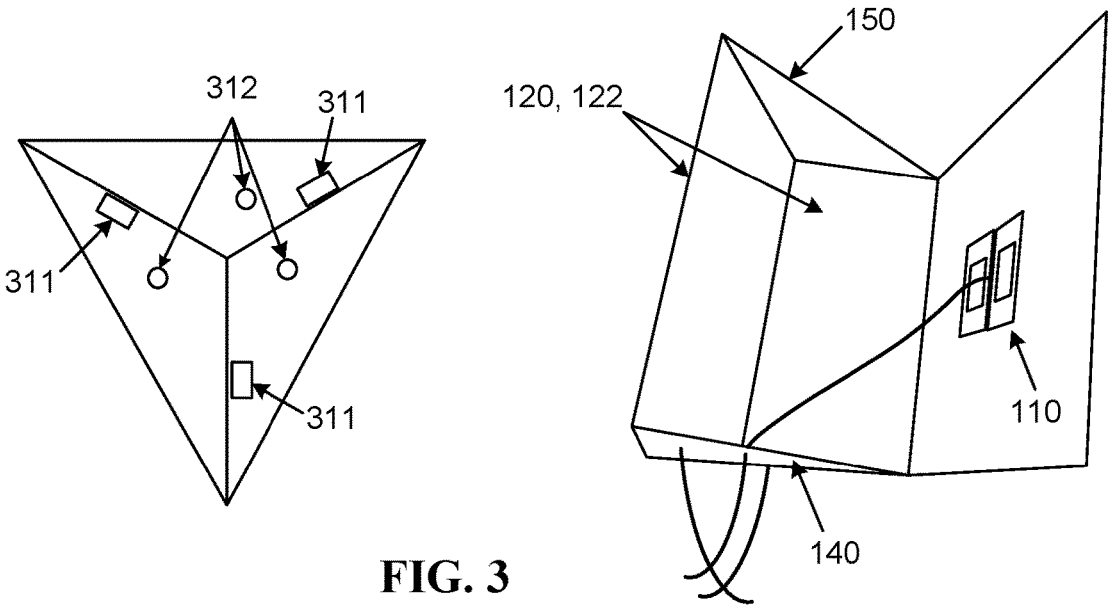
FIG. 3 schematically illustrates a picture of a real antenna with a first bottom plate embodiment according to an embodiment of the present disclosure.

In the following, possible specific implementations of the antenna 100 will be described in detail with reference to FIGS. 3 and 4, wherein two alternative designs of the bottom plate 140 of the antenna 100 are adopted to satisfy different assembly requirements. FIG. 3 schematically illustrates a real antenna 100 with a first bottom plate embodiment according to an embodiment of the present disclosure.

As shown in FIG. 3, the radiating plate 110 includes a substrate with two parallel sides. In an implementation, the substrate of the radiating plate 110 may employ a high frequency substrate material, which is 30 mil thick Rogers 4533 with a permittivity of 3.45 and a dielectric loss tangent of 0.002. On one side of the substrate, a portion of the ground plane is configured to form arms of the planar dipole radiating element 130. The L-shaped feeding stub 210 is disposed on the other side of the substrate, coupling to one arm of the planar dipole radiating element 130 by an opening-end. In the embodiment of FIG. 3, a 50Ωcoaxial feeding probe is used to feed the antenna 100. To improve the operation bandwidth of the antenna 100, the arms of the planar dipole radiating element 130 have been widen and digged out a piece in the center to change the current distribution of the antenna 100.

In the embodiment depicted by FIG. 3, the antenna 100 includes three radiating plates (only the radiating plate 110 is shown), three reflecting plates (only reflecting plates 120 and 122 are shown), a bottom plate 140 and a top plate 150. Three identical printed radiating plates are separated by an angle of 120 degrees. The three reflecting plates are also separated by an angle of 120 degrees, with a 60-degree rotation from the coordinates of the radiating plates. As mentioned above, the reflecting plates are used to generate directional radiation patterns. In the specific embodiment for particular design parameters as depicted in FIG. 3, the substrate of the reflecting plates can be a 0.8 mm thick FR4 substrate with copper cladded on both sides. The bottom plate 140 and the top plate 150 are both used to hold the radiating plates and the reflecting plates, and they may have some sockets (plugs and receptacles). In the specific embodiment, the bottom plate 140 and the top plate 150 may employ a 1.6 mm thick FR4 substrate.

In the first embodiment of the bottom plate 140 as shown in FIG. 3, the bottom plate 140 plays a role of fixing the radiating plates and the reflecting plates, whereas control circuits and radio frequency circuits are disposed external to the antenna 100. For example, the bottom plate 140 is provided with three plugs 311 to support the reflecting plates. Besides, the bottom plate 140 is also provided with three holes 312 to allow radio frequency (RF) cables to pass and connect to the external single-pole multi-throw (SPNT) switch or other components.

It is noted that the above specific values described with reference to FIG. 3 are determined for a particular application scenario and design, which is only for the purpose of examples without suggesting any limitations on the scope of the present disclosure. According to specific requirements and application, any other suitable values are also possible.

Figure 4:
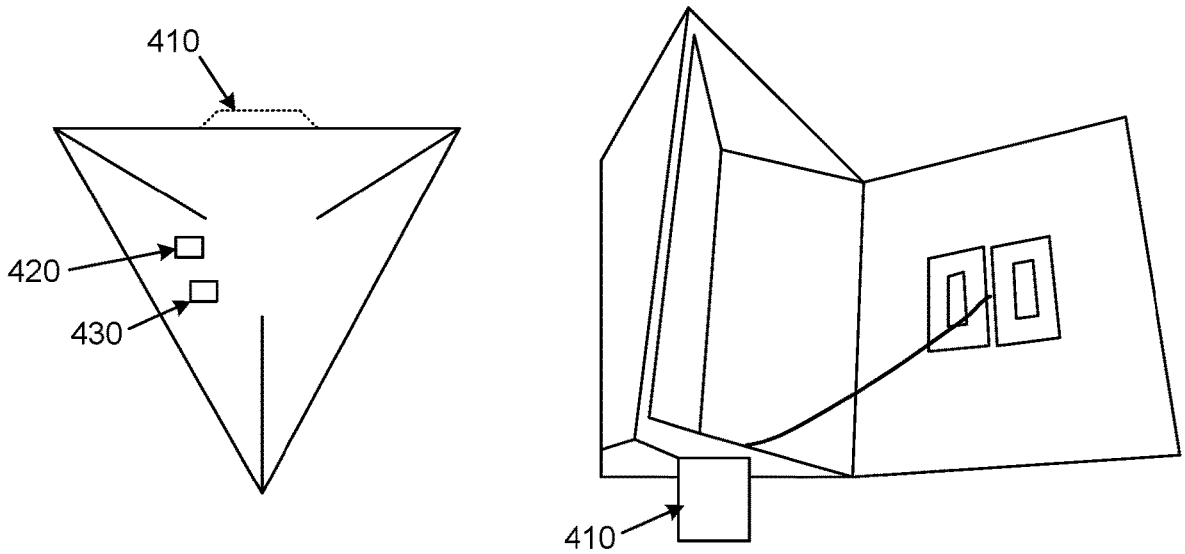
FIG. 4 schematically illustrates a picture of a real antenna with a second bottom plate embodiment according to an embodiment of the present disclosure.

FIG. 4 schematically illustrates a real antenna 100 with a second bottom plate embodiment according to an embodiment of the present disclosure. In FIG. 4, apart from the bottom plate 140, other components of the antenna 100 have structures and parameters similar to the antenna 100 in FIG. 3 and will not be repeated there. As shown in FIG. 4, in the second embodiment of the bottom plate 140, in addition to the role of fixing the radiating plates and the reflecting plates, the bottom plate 140 is provided with control circuits and radio frequency circuits or the like of the antenna 100. For example, a SP3T switch 430 and three RF ultraminiature coaxial connectors (not shown) are arranged on the top of the substrate of the bottom plate 140, and an SMA connector 420 and a RJ-45 connector 410 are disposed on the other side of the substrate of the bottom plate 140. In this way, a beam diversity operation may be activated by feeding one of the three selectable radiating plates composing a switched beam array via the SP3T switch 430. Therefore, the beam shaping is not implemented and the same beams are steered only in a discrete set of possible positions instead.

Figure 5:
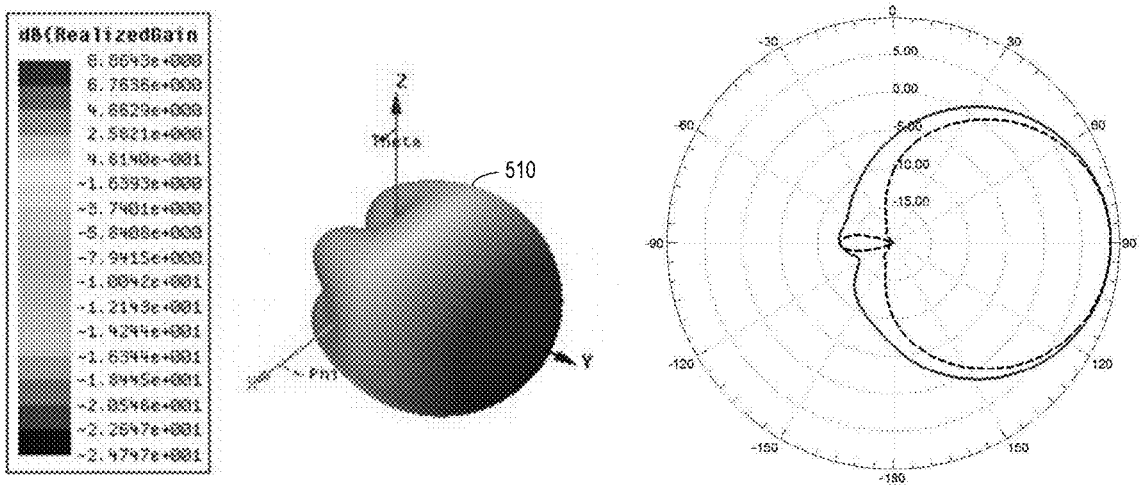
FIG. 5 schematically illustrates a simulated radiation pattern of the antenna according to an embodiment of the present disclosure at a particular frequency.

FIG. 5 schematically illustrates a simulated radiation pattern of the antenna 100 according to an embodiment of the present disclosure at a particular frequency. In the embodiment of FIG. 5, the operation frequency of the antenna 100 is designed to cover the LTE band 3.4-3.6 GHz. The left graph of FIG. 5 demonstrates a three-dimensional (3D) radiation pattern at 3.5 GHz resulting from selecting one radiating plate (antenna branch) of the antenna 100. The right graph uses solid lines and dotted lines respectively to demonstrate cross sections of the radiation pattern in the X-Y plane and the Y-Z plane. As shown in FIG. 5, the realized gain in the simulation is 8.9 dBi with a 70 degree of the half power beam width (HPBW) in the X-Y plane and a 62 degree of the HPBW in the Y-Z plane. The front-back ratio of the gain is greater than 20 dB. Therefore, the antenna 100 is suitable for RSSI indoor positioning applications.

Figure 6:
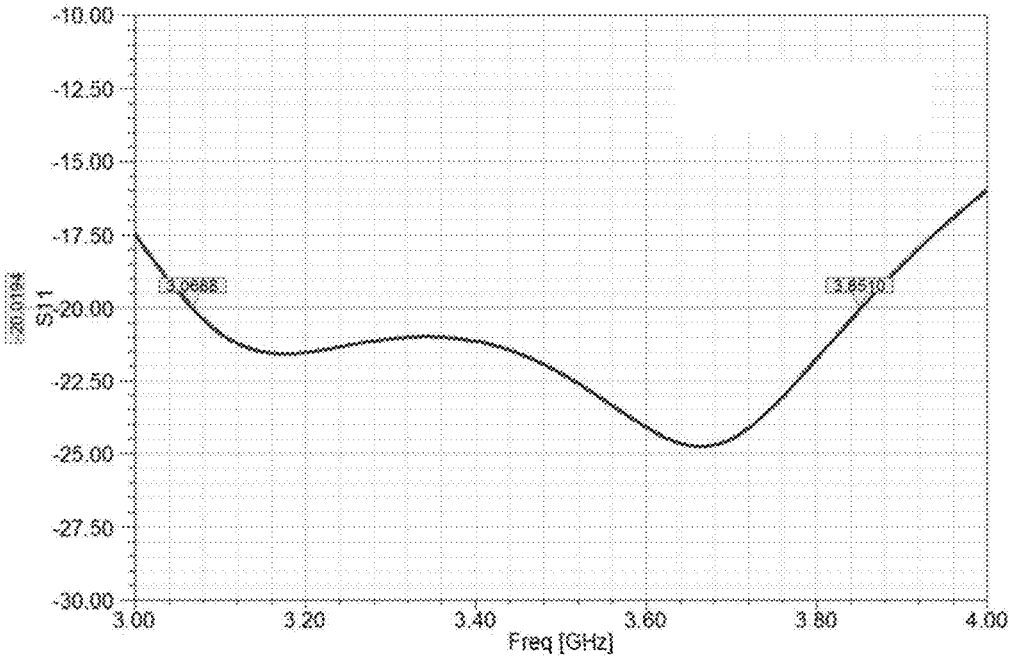
FIG. 6 schematically illustrates simulated return loss of the antenna according to an embodiment of the present disclosure.

FIG. 6 schematically illustrates simulated return loss of the antenna 100 according to an embodiment of the present disclosure. As shown in FIG. 6, the −20 dB operation band of the antenna 100 is about 3.07-3.85 GHz, which is approximate to 22.3% of the central operation frequency and can completely meet the requirement of the LTE B22/B42 frequency bands. It should be understood that the dimension of the antenna 100 may be changed and/or scaled, in order to operate in other LTE frequency bands at lower frequencies.

Figure 7:
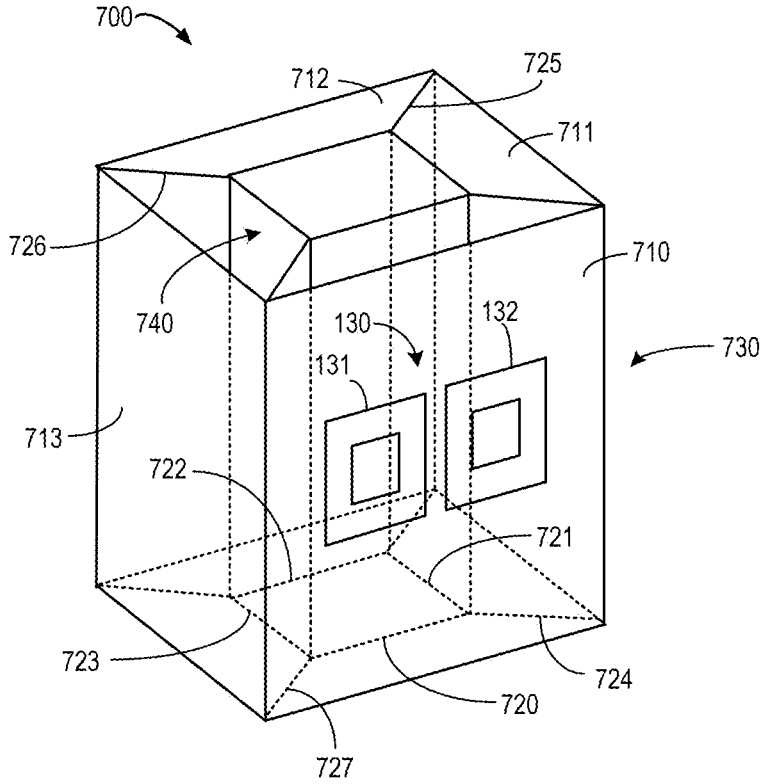
FIG. 7 schematically illustrates an antenna according to another embodiment of the present disclosure.

As mentioned above, the antenna according to the embodiments of the present disclosure may have other numbers of radiating plates and/or reflecting plates, which may have various other position relationships. For example, FIG. 7 schematically illustrates an antenna 700 according to another embodiment of the present disclosure. It will be appreciated that the antenna has a larger number of radiating plates and reflecting plates in the embodiment depicted by FIG. 7.

As shown in FIG. 7, different from the antenna 100, the antenna 700 includes four radiating plates 710, 711, 712 and 713. The structure of the radiating plates 710, 711, 712 and 713 can be similar to that of the radiating plates 110, 111 and 112 of the antenna 100 and will not be repeated here.

Besides, different from the antenna 100, the antenna 700 includes eight reflecting plates 720, 721, 722, 723, 724, 725, 726 and 727 for reflecting electromagnetic waves, such that the electromagnetic waves radiated by the radiating plates 710, 711, 712 and 713 each have a respective directional radiation pattern. For example, in the embodiment of FIG. 7, the reflecting plates 720, 721, 722 and 723 may be in parallel with the radiating plates 710, 711, 712 and 713, respectively, and form an internal regular quadrangular prism 740 within the regular quadrangular prism 730 consisting of the radiating plates 710, 711, 712 and 713. The reflecting plates 724, 725, 726 and 727 may respectively be positioned in the four planes defined by the lateral edges of the internal regular quadrangular prism 740 and the corresponding lateral edges of the regular quadrangular prism 730.

Under such an arrangement, the identical printed radiating plates 710, 711, 712 and 713 are arranged sequentially with an angle of 90 degrees to form the regular quadrangular prism 730 for example. The setting of the reflecting plates 720, 721, 722, 723, 724, 725, 726 and 727 is changed with respect to the setting of the reflecting plates in the antenna 100 to optimize the gain pattern and the return loss. Specifically, the reflecting plates 720, 724 and 727 jointly reflect the electromagnetic waves radiated by the radiating plate 710, such that the electromagnetic waves of the radiating plate 710 have a substantially forward radiation pattern.

Similarly, the reflecting plates 721, 724 and 725 jointly reflect the electromagnetic waves radiated by the radiating plate 711, such that the electromagnetic waves of the radiating plate 711 have a substantially forward radiation pattern. The reflecting plates 722, 725 and 726 jointly reflect the electromagnetic waves radiated by the radiating plate 712, such that the electromagnetic waves of the radiating plate 712 have a substantially forward radiation pattern. The reflecting plates 723, 726 and 727 jointly reflect the electromagnetic waves radiated by the radiating plate 713, such that the electromagnetic waves of the radiating plate 713 have a substantially forward radiation pattern.

Figure 8:
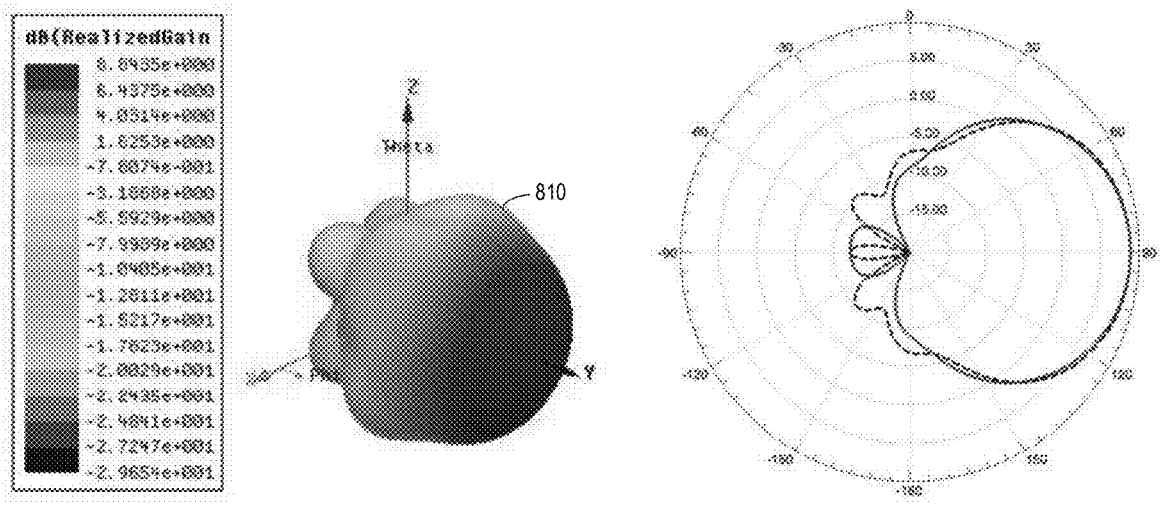
FIG. 8 schematically illustrates a simulated radiation pattern of the antenna according to another embodiment of the present disclosure at a particular frequency.

FIG. 8 schematically illustrates a simulated radiation pattern of the antenna 700 according to another embodiment of the present disclosure at a particular frequency. The left graph of FIG. 8 demonstrates a three-dimensional (3D) radiation pattern of the antenna 700 at 3.5 GHz resulting from selecting one radiating plate (antenna branch) of the antenna 700. The right graph uses solid lines and dotted lines respectively to demonstrate cross sections of the radiation pattern in the X-Y plane and the Y-Z plane. As shown in FIG. 8, the realized gain in the simulation is 8.8 dBi with a 68 degree of the HPBW in the X-Y plane and a 72 degree of the HPBW in the Y-Z plane. The front-back ratio of the gain is also greater than 20 dB. Therefore, the antenna 700 is suitable for RSSI indoor positioning applications.

Figure 9:
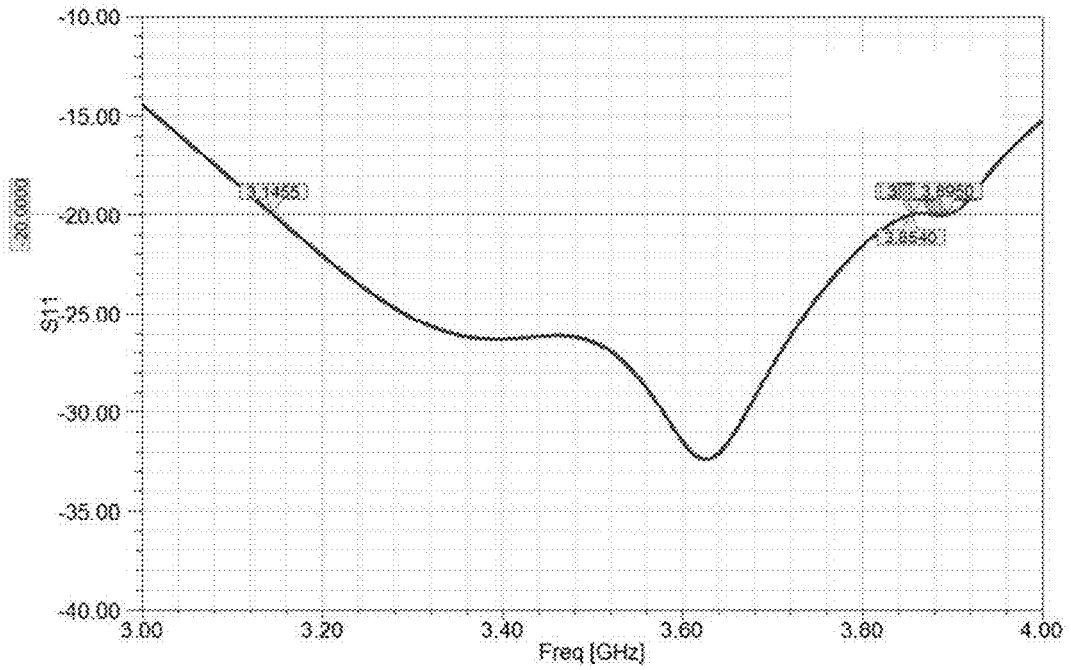
FIG. 9 schematically illustrates simulated return loss of the antenna according to another embodiment of the present disclosure.

FIG. 9 schematically illustrates simulated return loss of the antenna 700 according to another embodiment of the present disclosure. As shown in FIG. 9, the −20 dB operation band of the antenna 700 is about 3.14-3.85 GHz, which is approximate to 20% of the central operation frequency and can completely meet the design requirements. It should be understood that the dimension of the antenna 700 may be changed and/or scaled, in order to operate in other LTE frequency bands at lower frequencies.

The embodiments of the present disclosure provide a radiation pattern switchable reconfigurable antenna of broadband horizontal polarization at lower costs. The antenna is a proposed design for 5G indoor positioning applications, which can flexibly optimize its coverage to improve user experience and reduce interference. The antenna of the embodiments of the present disclosure may include the following features: a linear polarization antenna combination; selecting suitable radiating elements by a RF switch for feeding; a simplified feeding and control signal network; a bandwidth at least greater than 200 MHz (−20 dB); high gains and excellent performance in front-back ratio of the gain pattern. Furthermore, the antenna of the embodiments of the present disclosure may be manufactured with a printed circuit board (PCB) process to achieve higher precision and lower costs.

Compared with existing radiation pattern reconfigurable antennas having similar functions, the antenna according to the embodiments of the present disclosure has the following advantages. It has a compact size and utilizes the PCB process for manufacture to achieve higher precision and lower costs. It has a broader bandwidth, which is at least greater than 200 MHz (−20 dB) and far broader than existing antennas having similar functions. It has a simplified control circuit, which may use only one SP3T switch and require only three control signals. It has a better front-back ratio of the gain and improves positioning accuracy by reducing interference signals.

Figure 10:
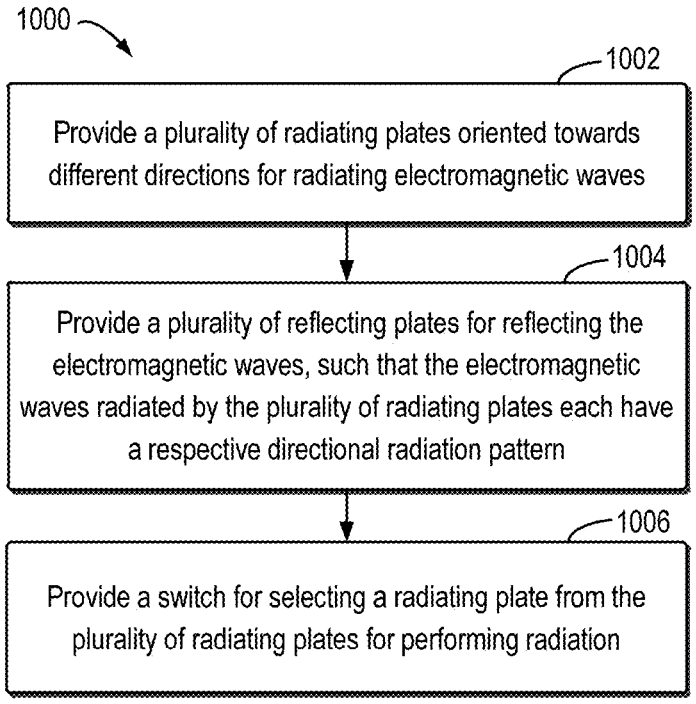
FIG. 10 schematically illustrates a flowchart of a method for manufacturing the antenna according to an embodiment of the present disclosure.

Furthermore, the embodiments of the present disclosure also provide a method for manufacturing the antenna as described above. As shown in FIG. 10, in an embodiment, the manufacturing method 1000 may include providing (1002) a plurality of radiating plates oriented towards different directions for radiating electromagnetic waves; providing (1004) a plurality of reflecting plates for reflecting the electromagnetic waves, such that the electromagnetic waves radiated by the plurality of radiating plates each have a respective directional radiation pattern; and providing (1006) a switch for selecting a radiating plate from the plurality of radiating plates for performing radiation.

In some embodiments, the method 1000 includes disposing a planar dipole radiating element on one side of the plurality of radiating plates. In some embodiments, providing a planar dipole radiating element includes symmetrically disposing metal rings with respect to a symmetry axis. In some embodiments, rectangular metal rings may be provided. In some embodiments, a width of a metal patch of the metal rings may be set to broaden an operation bandwidth of the antenna to a predetermined bandwidth.

In some embodiments, an L-shaped feeding stub may be disposed on the other side of the plurality of radiating plates according to the manufacturing method 1000. In some embodiments, an end of the feeding stub may be connected to one of the metal rings through a via. In some embodiments, the planar dipole radiating element may be fed through a coaxial cable.

In some embodiments, the plurality of radiating plates may form sides of a regular prism. For example, in some embodiments, a regular triangular prism may be formed. Correspondingly, three radiating plates and three reflecting plates may be provided, wherein the three reflecting plates are respectively arranged in three planes defined by lateral edges and a center axis of the regular triangular prism.

In some embodiments, a regular quadrangular prism may be formed. Correspondingly, four radiating plates and eight reflecting plates may be provided, such that four of the eight reflecting plates are respectively in parallel with the four sides of the regular quadrangular prism and form an internal regular quadrangular prism inside the regular quadrangular prism. The other four reflecting plates are respectively positioned in the four planes defined by lateral edges of the internal regular quadrangular prism and the corresponding lateral edges of the regular quadrangular prism.

In some embodiments, the manufacturing method 1000 may further include providing a bottom plate for fixing the plurality of radiating plates and the plurality of reflecting plates. In some embodiments, the bottom plate also provides an electrical connection for the plurality of radiating plates. In some embodiments, the switch is disposed on the bottom plate.

In some embodiments, the manufacturing method 1000 may further include providing a top plate for fixing the plurality of radiating plates and the plurality of reflecting plates.

It should be understood that all features described above with reference to the exemplary structure of the antenna are applicable to the corresponding manufacturing method and will not be repeated here.

As used herein, the term "includes" and its variants are to be read as open-ended terms that mean "includes, but is not limited to." The term "based on" is to be read as "based at least in part on." The term "one embodiment" and "the embodiment" are to be read as "at least one example embodiment."

The present disclosure has been described with reference to the several concrete embodiments. However, it should be understood that the present disclosure is not limited to the concrete embodiments disclosed herein. The present disclosure aims to encompass various modifications and equivalent arrangements included within the spirits and scope of the attached claims.

We claim:

1. An antenna, comprising:

a plurality of radiating plates oriented towards different directions for radiating electromagnetic waves;

a plurality of reflecting plates for reflecting the electromagnetic waves, such that the electromagnetic waves radiated by the plurality of radiating plates each have a respective directional radiation pattern; and a switch for selecting a radiating plate from the plurality of radiating plates for performing radiation.

2. The antenna of claim 1, wherein a planar dipole radiating element is disposed on one side of the plurality of radiating plates.

3. The antenna of claim 2, wherein the planar dipole radiating element includes metal rings symmetrically disposed with respect to a symmetry axis.

4. The antenna of claim 3, wherein the metal rings are rectangular metal rings.

5. The antenna of claim 3, wherein a width of a metal patch of the metal rings is set to broaden an operation bandwidth of the antenna to a predetermined bandwidth.

6. The antenna of claim 3, wherein an L-shaped feeding stub is disposed on an interior side of each of the plurality of radiating plates.

7. The antenna of claim 6, wherein an end of the feeding stub is connected to one of the metal rings through a via.

8. The antenna of claim 1, wherein the plurality of radiating plates form sides of a regular prism.

9. The antenna of claim 8, wherein the regular prism is a regular triangular prism and the plurality of radiating plates are three radiating plates, and wherein the plurality of reflecting plates are three reflecting plates, the three reflecting plates respectively being positioned in three planes defined by lateral edges and a center axis of the regular triangular prism.

10. The antenna of claim 9, wherein the regular prism is a regular quadrangular prism and the plurality of radiating plates are four radiating plates, and wherein the plurality of reflecting plates are eight reflecting plates, four reflecting plates of the eight reflecting plates, being respectively in parallel with four sides of the regular quadrangular prism and forming an internal regular quadrangular prism within the regular quadrangular prism, the other four reflecting plates of the eight reflecting plates respectively being positioned in four planes defined by lateral edges of the internal regular quadrangular prism and corresponding lateral edges of the regular quadrangular prism.

11. The antenna of claim 1, further comprising:

a bottom plate for fixing the plurality of radiating plates and the plurality of reflecting plates.

12. The antenna of claim 11, wherein the bottom plate also provides an electrical connection for the plurality of radiating plates.

13. The antenna of claim 11, wherein the switch is disposed on the bottom plate.

14. The antenna of claim 11, further comprising:

a top plate for fixing the plurality of radiating plates and the plurality of reflecting plates.

15. A method for manufacturing an antenna comprising:

providing a plurality of radiating plates oriented towards different directions for radiating electromagnetic waves;

providing a plurality of reflecting plates for reflecting the electromagnetic waves, such that he electromagnetic waves radiated by the plurality of radiating plates each have a respective directional radiation pattern; and providing a switch for selecting a radiating plated from the plurality of radiating plates for performing radiation.

* * * * *